US007733071B2

(12) United States Patent
Ritschel

(10) Patent No.: US 7,733,071 B2
(45) Date of Patent: Jun. 8, 2010

(54) DEVICE FOR SMOOTHING THE LOAD CURRENT SUPPLIED TO A LOAD

(75) Inventor: Reinhard Ritschel, Waldkraiburg (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 266 days.

(21) Appl. No.: 11/814,555

(22) PCT Filed: Jan. 16, 2006

(86) PCT No.: PCT/EP2006/000334

§ 371 (c)(1),
(2), (4) Date: Sep. 27, 2007

(87) PCT Pub. No.: WO2006/079463

PCT Pub. Date: Aug. 3, 2006

(65) Prior Publication Data

US 2008/0191676 A1 Aug. 14, 2008

(30) Foreign Application Priority Data

Jan. 26, 2005 (DE) ..... 10 2005 003 686

(51) Int. Cl.
*G05F 1/40* (2006.01)
*G05F 1/613* (2006.01)

(52) U.S. Cl. ..... 323/268; 323/225

(58) Field of Classification Search ..... 323/222–225, 323/266, 268–272, 282, 285, 349–351
See application file for complete search history.

(56) References Cited

U.S. PATENT DOCUMENTS

| | | | | |
|---|---|---|---|---|
| 3,325,724 | A | 6/1967 | Aiken | |
| 4,186,335 | A * | 1/1980 | Cahill | 320/103 |
| 4,253,055 | A * | 2/1981 | Gatten | 323/284 |
| 5,260,644 | A | 11/1993 | Curtis | |
| 5,313,153 | A | 5/1994 | Locher et al. | |
| 5,506,493 | A | 4/1996 | Stengel | |
| 6,608,470 | B1 * | 8/2003 | Oglesbee et al. | 320/136 |

FOREIGN PATENT DOCUMENTS

| | | |
|---|---|---|
| DE | 1438892 | 11/1968 |
| DE | 3805031 | 8/1989 |
| DE | 4123416 | 1/1993 |
| DE | 10115813 | 10/2002 |
| JP | 63036415 | 2/1988 |

OTHER PUBLICATIONS

International Search Report based on the counterpart international application PCT/EP2006/000334; Date of Mailing Apr. 20, 2006.

* cited by examiner

*Primary Examiner*—Matthew V Nguyen
(74) *Attorney, Agent, or Firm*—Marshall, Gerstein & Borun LLP

(57) ABSTRACT

The invention relates to smoothing a consumer electrical circuit supplied by a controllable current sink connected in parallel to the consumer. For this purpose, measuring voltage proportional to a load current supplied to the consumer is derived therefrom. A pick value measuring device makes it possible to determine a maximum value thereof. The difference between the maximum value and measuring voltage makes it possible to control the voltage-controlled current sink in such a way that the sum of a compensation current supplied by the current sink and the load current which runs by the consumer is substantially constant.

3 Claims, 1 Drawing Sheet

DEVICE FOR SMOOTHING THE LOAD CURRENT SUPPLIED TO A LOAD

BACKGROUND OF THE INVENTION

1. Field of Invention

The invention relates to a device for smoothing a load current supplied to a load by a controllable current sink connected in parallel to the load.

2. Related Technology

In the case of electronic devices with circuits with a strongly-fluctuating current consumption, it is often necessary to smooth the load current supplied from a direct-current source. However, the use of conventional LC filters with large smoothing condensers is often precluded because of lack of space. It is, in fact, already known that, in order to smooth a pulsating direct-current supply, a controllable current sink can be connected in parallel to the load, and the total input current resulting from the sum of the load current and the compensation current can be measured and compared with a specified set value and, dependent upon the latter, the compensation current can be regulated via the current sink in such a manner that the supply current remains substantially constant. However, this known regulating circuit is relatively complex and often not fast enough; it is unstable and tends to oscillate.

SUMMARY OF THE INVENTION

The invention provides a device for smoothing the load current supplied to a load, which avoids the disadvantages of compensation-current regulation in spite of its small space requirement.

According to the invention, a device is provided for smoothing a load current supplied to a load by a controllable current sink connected in parallel to the load, wherein a measured voltage proportional to the load current is derived from the load current supplied to the load; its maximum value is determined by means of a peak detector (S); and the voltage-controlled current sink is controlled with the difference between the maximum value and the measured voltage in such a manner that the sum of the compensation current flowing through the current sink and the load current flowing through the load is substantially constant.

With the device according to the invention, the compensation current generated by the current sink is not obtained by regulation but by control. A device of this kind is therefore very fast and stable and automatically adapts even to relatively rapid changes in load current.

BRIEF DESCRIPTION OF THE DRAWING

The invention is explained in greater detail below on the basis of an exemplary embodiment with reference to a schematic circuit diagram. The drawings are as follows.

DETAILED DESCRIPTION

Figure 1:
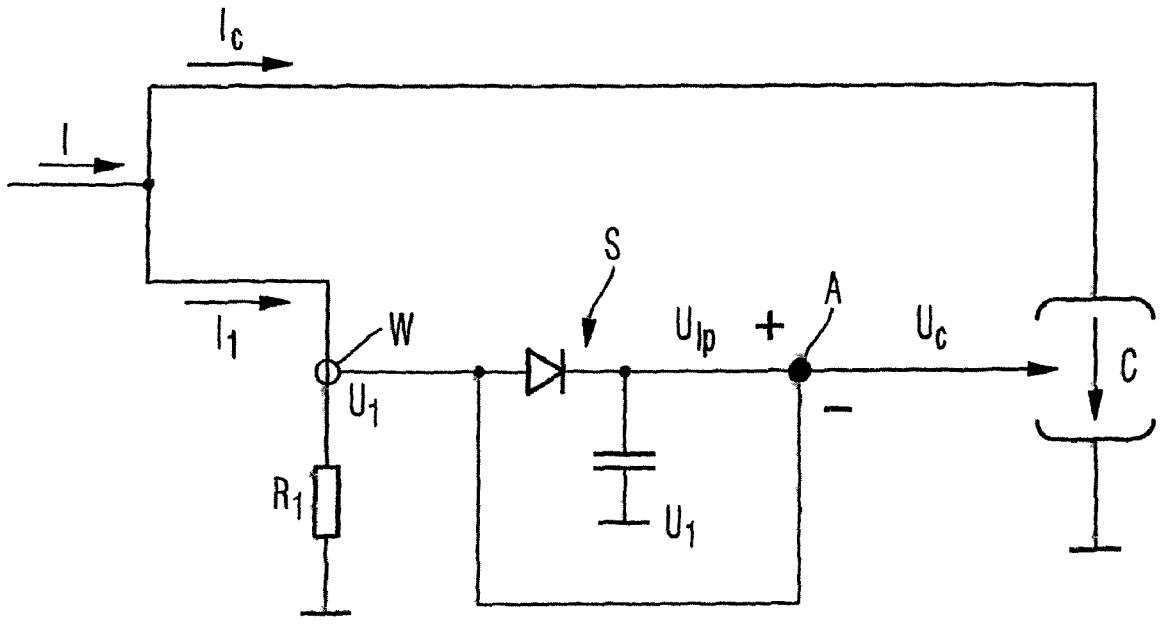
FIG. 1 shows a schematic circuit diagram of an exemplary embodiment of the device according to the invention.

The drawing shows a device according to the invention for smoothing the direct load current I supplied to a load $R_1$ by a controllable current sink C connected in parallel to the load $R_1$.

This voltage-controlled current sink C is, in principle, a controlled load. In modern circuit technology, it is preferably realised by controllable transistors combined with corresponding resistors. The total load current I, which is supplied to the load $R_1$ from a direct-current source, which is not illustrated, is composed of the sum of the load current $I_1$ supplied to the load $R_1$ and the compensation current $I_c$ flowing through the current sink C. The load current $I_1$ is converted into a proportional measured voltage $U_1$ by a current/voltage converter W. The converter W is, for example, a shunt arranged in the load-current circuit.

The maximum value $U_{1p}$ of the measured voltage $U_1$ is determined by a peak detector S, and the difference between the maximum value $U_{1p}$ and the momentary value $U_1$ is determined in a voltage adder A. The result $U_c$ controls the compensation current $I_c$ in the current sink C in such a manner that the load current $I=I_1-I_c$ is substantially constant and fluctuates only slightly.

The filter effect of the device according to the invention is determined by the accuracy of the measurement of the load current $I_1$ and the accuracy of control of the current sink C. The response time and discharge time of the peak detector S, as well as the mean value for the maximum value of the measured voltage obtained through this peak detector and the derivative action of the momentary value $U_1$ of the measured voltage proportional to the load current are dimensioned in such a manner that, for a specified load-current characteristic $I_1$, an optimum is obtained with regard to the filter effect and power loss in the current sink C.

By preference, a switching device, which is not illustrated, but through which the compensation current $I_c$ is switched on and off together with the load $R_1$, is also allocated to the current-compensation circuit. Moreover, the peak-compensation current $I_c$ is specified by a corresponding limitation of the maximum value $U_{1p}$ determined in the peak detector. For this purpose, a corresponding voltage limiter is connected, for example, in parallel to the charging condenser of the peak detector S.

Furthermore, it is advantageous to limit the mean value of the compensation current $I_c$ and to monitor the temperature of the current sink C and, dependent upon the latter, to limit the maximum value $U_{1p}$, so that the filter effect is correspondingly limited and weakened in the event of an overload.

The invention is not restricted to the exemplary embodiment presented. All of the elements described and illustrated can be combined with one another as required.

The invention claimed is:

1. A device for smoothing a load current supplied to a load by a controllable current sink connected in parallel to the load and to a peak detector, wherein a measured voltage proportional to the load current is derived from the load current supplied to the load; its maximum value is determined by means of the peak detector; and the voltage-controlled current sink is controlled with the difference between the maximum value and the measured voltage in such a manner that the sum of the compensation current flowing through the current sink and the load current flowing through the load is substantially constant, wherein the maximum value of the measured voltage is limited to a predetermined value by a voltage limiter;

wherein the mean value of the compensation current of the current sink and the temperature of the current sink are determined, and the limitation of the maximum value is determined dependent upon the latter, so that, in the event of an overload, the filter effect is correspondingly limited and attenuated.

2. The device according to claim 1, wherein the measured voltage proportional to the load current is measured in a shunt resistor arranged in the load-current circuit, and the maximum value of this measured voltage is measured by means of a peak detector.

3. The device according to claim 1, wherein the arrangement can be switched on and off together with the load by a switching device.

* * * * *